US008440921B2

(12) United States Patent
Xu

(10) Patent No.: US 8,440,921 B2
(45) Date of Patent: May 14, 2013

(54) KEYPAD

(75) Inventor: Zhong Xu, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 323 days.

(21) Appl. No.: 12/886,543

(22) Filed: Sep. 20, 2010

(65) Prior Publication Data

US 2011/0155553 A1 Jun. 30, 2011

(30) Foreign Application Priority Data

Dec. 31, 2009 (CN) ..... 2009 1 0312981

(51) Int. Cl.
*H01H 9/26* (2006.01)
*H01H 13/72* (2006.01)
*H01H 13/76* (2006.01)

(52) U.S. Cl.
USPC ..... 200/5 A; 200/5 B; 200/1 B

(58) Field of Classification Search ..... 200/5 A, 200/43.01, 43.18, 43.13, 43.16, 43.19, 50.36, 200/43.11, 5 B, 50.32, 50.33, 1 B
See application file for complete search history.

(56) References Cited

U.S. PATENT DOCUMENTS 5,994,652 A * 11/1999 Umemura ..... 200/5 B

* cited by examiner

*Primary Examiner* — Renee Luebke
*Assistant Examiner* — Lheiren Mae Caroc
(74) *Attorney, Agent, or Firm* — Altis Law Group, Inc.

(57) ABSTRACT

A keypad includes a circuit board, a key, and a rotating member. The circuit board includes at least one first keypad switch and at least one second keypad switch. The key includes a first protruding post configured for actuating the at least one first keypad switch, and a second protruding post for actuating the at least one second keypad switch. The rotating member is rotatably connected to the circuit board and able to retain in a first position and a second position. In the first position, the rotating member prevents the first protruding post from actuating the at least one first keypad switch and allows the second protruding post to actuate the at least one second keypad switch. In the second position, the rotating member allows the first protruding post to actuate the at least one keypad switch.

9 Claims, 5 Drawing Sheets

KEYPAD

BACKGROUND

1. Technical Field

The present disclosure relates to a keypad.

2. Description of Related Art

A keypad/keyboard is a common input device, and usually includes a number of keys. Once a key is depressed, a switch is actuated to generate a corresponding signal. A host device can identify the corresponding signal and executes a corresponding function. Although the conventional keyboards/keypads satisfy basic requirements, it is still desirable to provide a new keypad/keyboard.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Embodiments of the present disclosure will now be described in detail below, with reference to the accompanying drawings.

Figure 1:
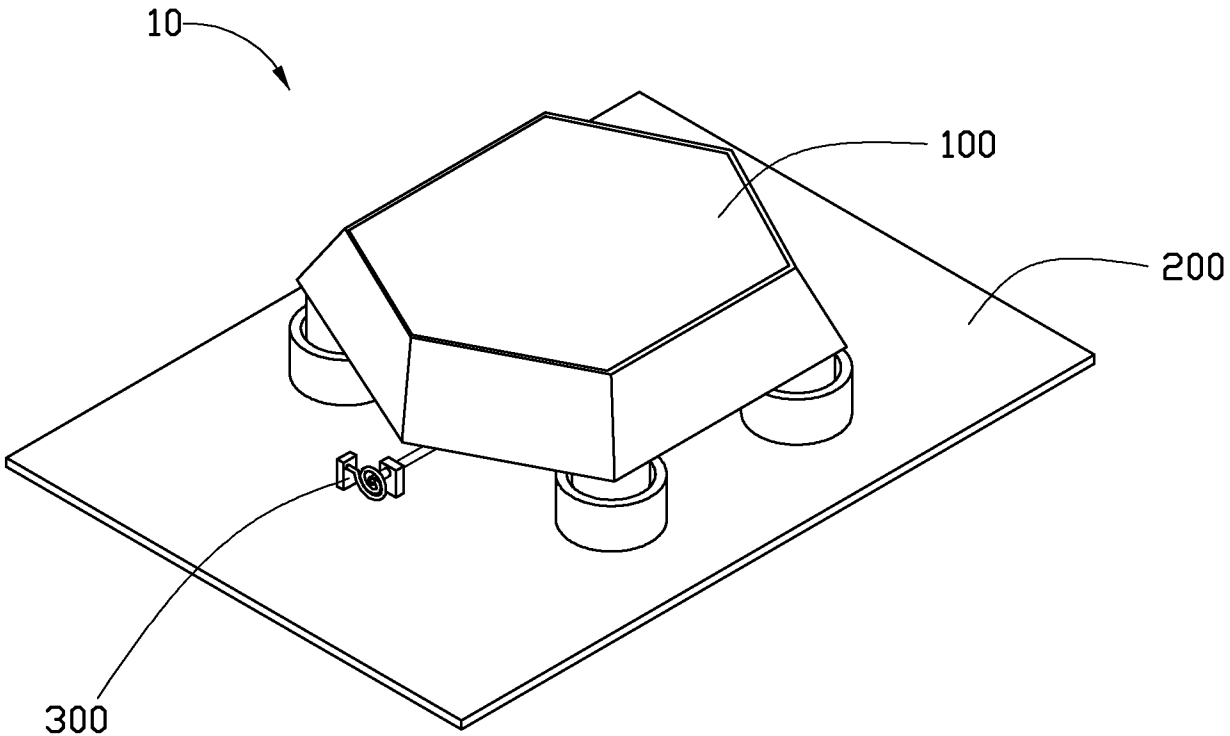
FIG. 1 is an isometric view showing a portion of a keypad in accordance with one embodiment.
Figure 2:
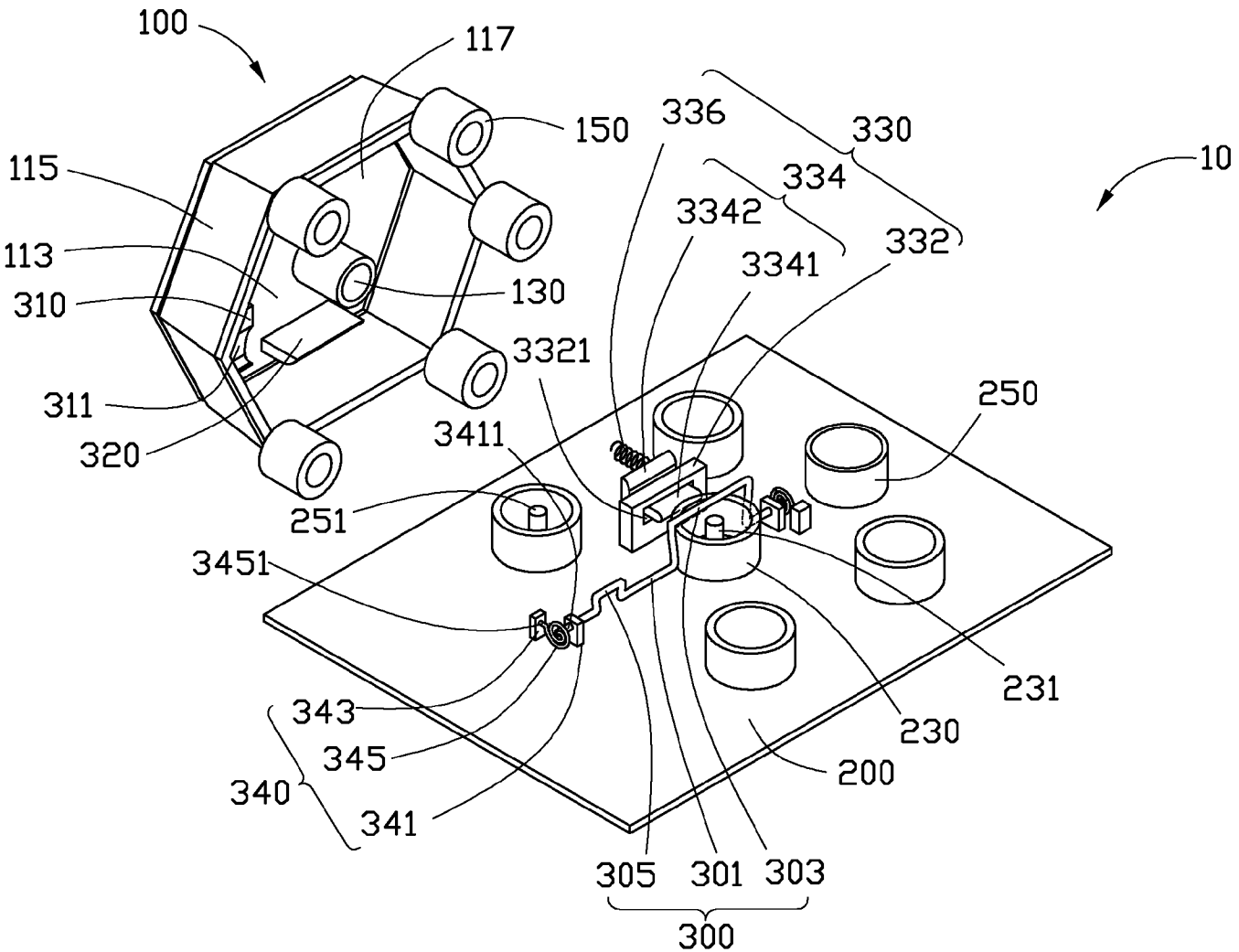
FIG. 2 is an isometric exploded view of the keypad of FIG. 1.

Referring to FIGS. 1 and 2, a portion of a keypad 10 is illustrated. The keypad 10 includes a key 100, a circuit board 200, and a rotating member 300. The key 100 includes a top 113 and a number of sidewalls 115 protruding from the top 113. The sidewalls 115 are connected together and cooperate with the top 113 to define a chamber 117. A first protruding post 130 protrudes from the top 113 and locates within the chamber 117. A number of second protruding posts 150 protrude from the edges of the sidewalls 115 along a direction substantially parallel to the protruding post 130.

Corresponding to the key 100, the circuit board 200 includes a first guiding member 230 and a number of second guiding members 250. The first guiding member 230 is hollow and accommodates a first keypad switch 231. Each second guiding member 250 is hollow and one of the guiding members 250 accommodates a second keypad switch 251. The protruding post 130 is aligned with and is spaced from the first guiding member 230, and the protruding posts 150 are slidably received in the second guiding members 250.

The rotating member 300 includes a segmented main bar 301, a first offset bar 303, and a second offset bar 305. The first offset bar 303 and the second offset bar 305 are spaced from the main bar 301. In the embodiment, a pair of first retaining members 340 is used to rotatably connect the rotating member 300 to the circuit board 200. Each of the retaining members 340 includes two fixing blocks 341 and 343 and an elastic member 345. The fixing block 341 defines an axle hole

3411 to allow one end of the main bar 301 to pass through, rotatably connecting the rotating member 300 to the fixing block 341. Two ends 3451 of the elastic member 345 are respectively attached to the fixing block 343 and the end of the main bar 301. The elastic members 345 of the retaining members 340 are used to retain the rotating member 300 in a first upright position. In the embodiment, the elastic members 345 are torsion springs.

The keypad 10 also includes a pushing member 310, a protruding tab 320, and a second retaining member 330. The pushing member 310 protrudes from the top 113 of the key 110 and locates within the chamber 117. The pushing member 310 defines a recessed surface 311 that is configured for engaging the second offset bar 305 of the rotating member 300, to push the rotating member 300 to rotate. In an alternative embodiment, the recessed surface 311 may be replaced with a sloped surface.

The protruding tab 320 protrudes from the top 113 of the key 110 and locates within the chamber 117. The second retaining member 330 includes a support 332, a sliding member 334, and a resilient member 336. The support 332 is substantially perpendicular to the circuit board 200 and defines a slot 3321 extending substantially parallel to the circuit board 200. The sliding member 334 includes a base 3341 and an arm 3342 substantially perpendicular to the base 3341. The base 3341 is slidably received in the slot 3321. Two ends of the resilient member 336 are respectively fixed to the circuit board 200 and the arm 3342 of the sliding member 334, to apply a spring force to the arm 3342. In the embodiment, the resilient member 336 is a coil spring. When pushed by the resilient member 336, the arm 3342 abuts against the support 332.

Figure 3:
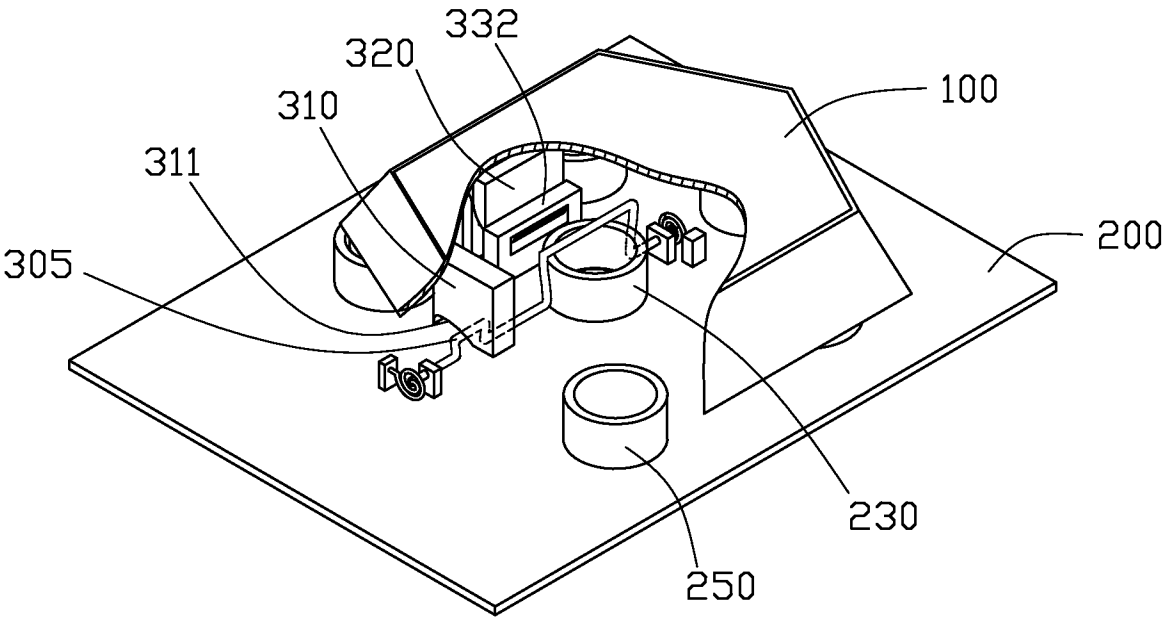
FIG. 3 is a cut-away view of the keypad of FIG. 1, showing a rotating member in an upright position.
Figure 4:
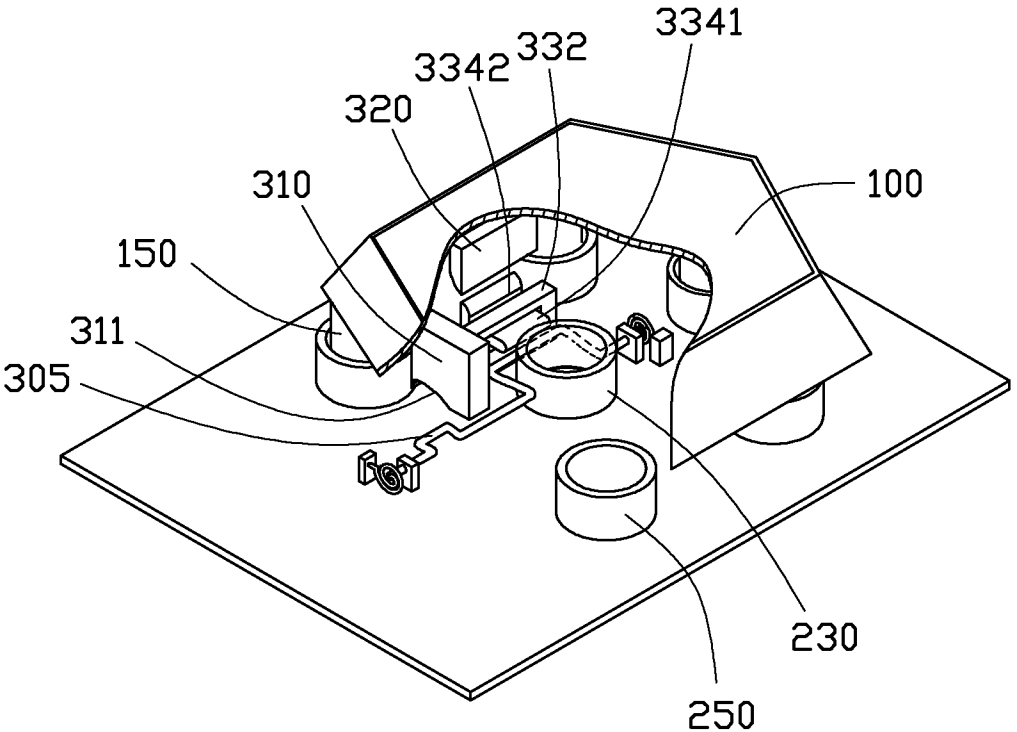
FIG. 4 is similar to FIG. 3, but showing the rotating member in a horizontal position.

Referring to FIGS. 3 and 4, when the rotating member 300 is in the first upright position, the first offset bar 303 locates between the protruding post 130 of the key 100 and the first guiding member 230, preventing the protruding post 130 from moving into the first guiding member 230. At this point, if the key 100 is depressed, the protruding posts 150 can slide into the guiding members 250 and actuate the second switches 251, generating a corresponding first signal. After receiving the first signal, a host device (not shown) can identify the first signal and execute a first predetermined function.

If the key 100 is further depressed, the pushing member 310 pushes the rotating member 300 to rotate. After the rotating member 300 rotates a predetermined angle, the first offset bar 303 contacts the base 3341 of the sliding member 334, and pushes the base 3341 to move. Once the first offset bar 303 comes out of contact with the base 3341 and rotates to a position under the base 3341, the base 33 is pushed by the resilient member 336 and moves back to its original position, preventing the first offset bar 303 from rotating back. The first offset bar 303 is thus retained in a second position. The first protruding post 130 thus frees from the limitation of the first offset bar 303, and can slide into the first guiding member 230 to actuate the first switch 231. At this point, both the first switch 231 and the second switch 251 are actuated. The host device can identify the combination of the signals from the first switch 231 and the second switch 251 and executes a second predetermined function. With such structure, one key of the keypad 10 can be used to inform the host device to execute two predetermined functions.

To rotate the rotating member 300 from the second position to the first position, the key 100 is depressed to cause the protruding tab 320 to engage the arm 3342 of the sliding member 334. The arm 3342 thus moves to allow that the first offset bar 303 frees from the limitation of the base 3341, and rotates back to the first upright position.

Figure 5:
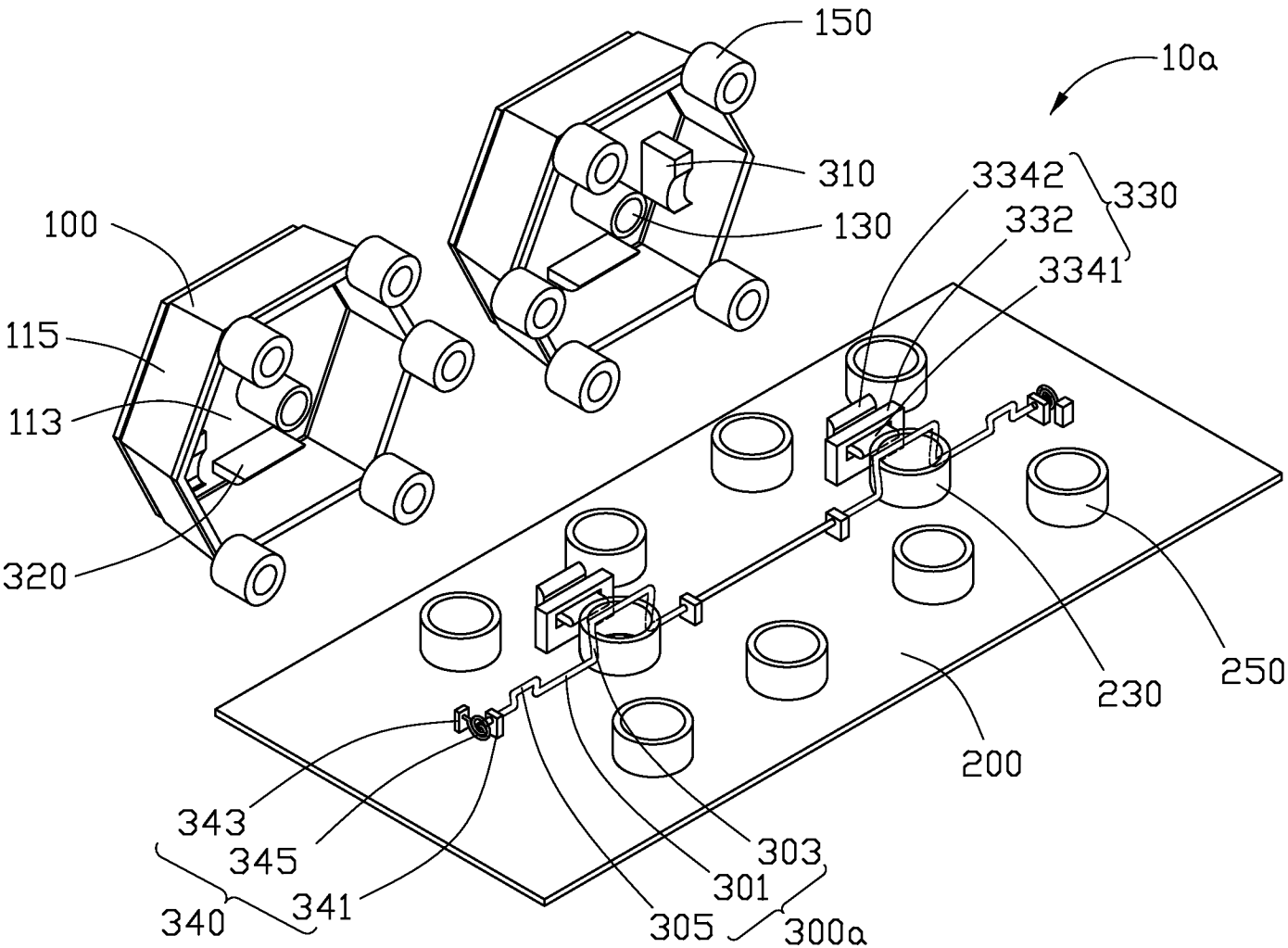
FIG. 5 is an isometric view showing a portion of a keypad in accordance with another embodiment.

Referring to FIG. 5, in an alternative embodiment, a portion of a second keypad 10*a* is illustrated. The difference between the keypads 10 and 10*a* is that a rotating member 300*a* is used for two keys 100. The rotating member 300*a* includes two offset bars 303 and two offset bars 305. When the rotating member 300*a* stays upright, either of the two keys 100 can independently actuate the second switches 251, and the first switches 231 are prevented by the offset bars 303 from being actuated. Pressing down on either or both of the keys 100 can push the rotating member 300*a* to rotate from the upright position to the second position, to allow the first switches 231 to be actuated by either of the two keys 100. To rotate the rotating member 300*a* back to the upright position, the two keys 100 need to be depressed simultaneously to allow that the offset bars 303 frees from the limitation of the two bases 3341 of the sliding members 334.

While various embodiments have been described and illustrated, the disclosure is not to be constructed as being limited thereto. Various modifications can be made to the embodiments by those skilled in the art without departing from the true spirit and scope of the disclosure as defined by the appended claims.

What is claimed is:

1. A keypad comprising:

a circuit board comprising at least one first keypad switch and at least one second keypad switch;

a key comprising a first protruding post configured for actuating the at least one first keypad switch, and a second protruding post for actuating the at least one second keypad switch; and a rotating member rotatably connected to the circuit board and able to retain in a first position and a second position;

wherein, in the first position, the rotating member prevents the first protruding post from actuating the at least one first keypad switch and allows the second protruding post to actuate the at least one second keypad switch; and in the second position, the rotating member allows the first protruding post to actuate the at least one first keypad switch, with the at least one second keypad switch actuated simultaneously by the second protruding post.

2. The keypad according to claim 1, further comprising a pair of first retaining members, wherein each of the first retaining members comprises a first fixing block and a second fixing block spaced from each other, and an elastic member comprising two ends, one of the two ends is fixed to the first fixing block, the second fixing block defines an axle hole to receive one end of the rotating member to allow the rotating member to rotate with respect to the second fixing block, the other one of the two ends of the elastic member is connected to the one end of the rotating member, to apply a rebounding force to retain the rotating member in the first position.

3. The keypad according to claim 2, wherein the elastic member is a torsion spring.

4. The keypad according to claim 1, further comprising a second retaining member, wherein the second retaining member comprises a support, a sliding member, and a resilient member, the support is fixed on the circuit board and defines a slot, the sliding member comprises a base and an arm perpendicularly protruding from one end of the base, the base is slidably received in the slot, two ends of the resilient member are respectively connected to the circuit board and the arm to apply a rebounding force to the arm, the arm is configured for retaining the rotating member in the second position, the key comprises a protruding tab formed on an inner surface thereof, the protruding tab is configured for engaging the arm to cause the base to move, allowing the rotating member to rotate back from the second position to the first position.

5. The keypad according to claim 1, wherein the rotating member comprises a segmented main bar and a first offset bar spaced from the main bar, when the rotating member is in the first position, the first offset bar stays between the first protruding post and the at least one keypad switch and prevents the protruding post from actuating the at least one keypad switch.

6. The keypad according to claim 5, wherein the rotating member further comprises a second offset bar spaced from the main bar, the key comprises a protrusion formed on an inner surface thereof, the protrusion is configured for engaging the second offset bar to push the rotating member to rotate.

7. A keypad comprising:

a circuit board comprising at least two first keypad switches and at least two second keypad switches;

two keys, each of the two keys comprising a first protruding post, a second protruding post, and a pushing member, the first protruding posts of the two keys being configured for respectively actuating the at least two first keypad switches, the second protruding posts of the two keys being configured for actuating the at least two second keypad switches;

a rotating member rotatably connected to the circuit board and able to retain in a first position and a second position; and two retaining members for retaining the rotating member in the second position, wherein the pushing members of the two keys are configured for pushing the two retaining members to move to allow the rotating member to rotate from the second position to the first position;

wherein, in the first position, the rotating member prevents the first protruding posts from actuating the at least two first keypad switches and allows the second protruding posts to actuate the at least two second keypad switches; in the second position, the rotating member allows the first protruding posts to actuate the at least two first keypad switches.

8. The keypad according to claim 7, wherein the rotating member comprises a segmented main bar and two first offset bars spaced from the main bar, when the rotating member is in the first position, each of the first offset bars stays between the first protruding posts and the at least two keypad switches, preventing the protruding posts from actuating the at least two first keypad switches.

9. The keypad according to claim 8, wherein the rotating member further comprises two second offset bars spaced from the main bar, each of the two keys comprises a protrusion formed on an inner surface thereof, the protrusions of the two keys are configured for respectively engaging the second offset bars to push the rotating member to rotate.

* * * * *